US009322584B2

(12) United States Patent
Piesker

(10) Patent No.: US 9,322,584 B2
(45) Date of Patent: Apr. 26, 2016

(54) COOLING SYSTEM FOR OPERATION WITH A TWO-PHASE REFRIGERANT

(71) Applicant: AIRBUS OPERATIONS GMBH, Hamburg (DE)

(72) Inventor: Markus Piesker, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 445 days.

(21) Appl. No.: 13/773,378

(22) Filed: Feb. 21, 2013

(65) Prior Publication Data

US 2013/0233004 A1 Sep. 12, 2013

Related U.S. Application Data

(60) Provisional application No. 61/602,608, filed on Feb. 24, 2012.

(30) Foreign Application Priority Data

Feb. 24, 2012 (EP) ..... 12001231

(51) Int. Cl.
*F25B 49/00* (2006.01)
*F25D 15/00* (2006.01)
*F25D 17/06* (2006.01)
(Continued)

(52) U.S. Cl.
CPC ..... *F25B 49/00* (2013.01); *F25B 23/006* (2013.01); *F25B 39/00* (2013.01)

(58) Field of Classification Search
CPC ..... F25B 23/006; F25B 39/00; F25B 49/00
USPC ..... 62/132
See application file for complete search history.

(56) References Cited

U.S. PATENT DOCUMENTS 5,647,221 A * 7/1997 Garris, Jr. ..... 62/116
6,866,092 B1 3/2005 Molivadas
6,904,760 B2 * 6/2005 Butsch ..... 62/115
(Continued)

FOREIGN PATENT DOCUMENTS

CN 101378959 3/2009
DE 10 2006 005 035 9/2007
(Continued)

OTHER PUBLICATIONS

Chinese Office Action dated Dec. 3, 2014.

*Primary Examiner* — Allen Flanigan
*Assistant Examiner* — Filip Zec
(74) *Attorney, Agent, or Firm* — Dickinson Wright PLLC

(57) ABSTRACT

A cooling system particularly suitable for use on board an aircraft includes a cooling circuit allowing circulation of a two-phase refrigerant therethrough. An evaporator in the cooling circuit has a refrigerant inlet and a refrigerant outlet. A condenser in the cooling circuit has a refrigerant inlet and a refrigerant outlet. A detection device is configured to output a signal indicative of the state of aggregation of the refrigerant in a connecting portion of the cooling circuit which connects the refrigerant outlet of the evaporator to the refrigerant inlet of the condenser. A control device is configured to control at least one of the temperature and the pressure of the refrigerant in the connecting portion of the cooling circuit in dependence on the signal output by the detection device such that the refrigerant in the connecting portion of the cooling circuit is maintained in its gaseous state of aggregation.

14 Claims, 2 Drawing Sheets

(51) Int. Cl.
*F25B 23/00* (2006.01)
*F25B 39/00* (2006.01)

(56) References Cited

U.S. PATENT DOCUMENTS

| | | | |
|---|---|---|---|
| 2009/0000329 | A1 | 1/2009 | Colberg |
| 2010/0251737 | A1 | 10/2010 | Roering |
| 2013/0019624 | A1 | 1/2013 | Tamaki |

FOREIGN PATENT DOCUMENTS

| | | |
|---|---|---|
| DE | 10 2009 011 797 | 9/2010 |
| DE | 10 2011 014 943 | 9/2012 |
| EP | 2 159 515 | 3/2010 |
| JP | 2001-235253 | 8/2001 |
| JP | 2006-112708 | 4/2006 |
| JP | 2007-64510 | 3/2007 |
| WO | 2007/088012 | 8/2007 |
| WO | 2011/125111 | 10/2011 |
| WO | 2012/000501 | 1/2012 |

* cited by examiner

COOLING SYSTEM FOR OPERATION WITH A TWO-PHASE REFRIGERANT

CROSS REFERENCE TO RELATED APPLICATIONS

This application is entitled to and claims the benefit of European Patent Application No. 12 001 231.5 and U.S. Provisional Application No. 61/602,608, both filed Feb. 24, 2012, the disclosures of which, including the specification, drawings and abstract, are incorporated herein by reference in their entirety.

FIELD

The invention relates to a cooling system, in particular for use on board an aircraft, which is suitable for operation with a two-phase refrigerant and a method of operating a cooling system of this kind.

BACKGROUND

Cooling systems for operation with a two-phase refrigerant are known from DE 10 2006 005 035 B3, WO 2007/088012 A1, DE 10 2009 011 797 A1 and US 2010/0251737 A1 and may be used for example to cool food that is stored on board a passenger aircraft and intended to be supplied to the passengers. Typically, the food provided for supplying to the passengers is kept in mobile transport containers. These transport containers are filled and precooled outside the aircraft and after loading into the aircraft are deposited at appropriate locations in the aircraft passenger cabin, for example in the galleys. In order to guarantee that the food remains fresh up to being issued to the passengers, in the region of the transport container locations cooling stations are provided, which are supplied with cooling energy from a central refrigerating device and release this cooling energy to the transport containers, in which the food is stored.

In the cooling systems known from DE 10 2006 005 035B3, WO 2007/088012 A1, DE 10 2009 011 797 A1 and US 2010/0251737 A1 the phase transitions of the refrigerant flowing through the circuit that occur during operation of the system allow the latent heat consumption that then occurs to be utilized for cooling purposes. The refrigerant mass flow needed to provide a desired cooling capacity is therefore markedly lower than for example in a liquid cooling system, in which a one-phase liquid refrigerant is used. Consequently, the cooling systems described in DE 10 2006 005 035 B3, WO 2007/088012 A1, DE 10 2009 011 797 A1 and US 2010/0251737 A1 may have lower tubing cross sections than a liquid cooling system with a comparable cooling capacity and hence have the advantages of a lower installation volume and a lower weight. What is more, the reduction of the refrigerant mass flow makes it possible to reduce the conveying capacity needed to convey the refrigerant through the cooling circuit of the cooling system. This leads to an increased efficiency of the system because less energy is needed to operate a corresponding conveying device, such as for example a pump, and moreover less additional heat generated by the conveying device during operation of the conveying device has to be removed from the cooling system.

A cooling system installed on board an aircraft must be capable for operation under various environmental conditions. For example, the cooling system must be capable to be operated at very high, but also at very low ambient temperatures. To maintain an undesired heat introduction into the cooling system at high ambient temperatures as low as possible, the tubing of the cooling system, in particular the tubing of a cooling circuit of the cooling system is insulated. The insulation of the tubing of the cooling system, however, in particular during longer immobilization times of the aircraft or during longer loading cycles with open cargo doors at low ambient temperatures usually is not sufficient to prevent the temperature of the tubing from falling below a dew point of the two-phase refrigerant. This may result in an undesired condensation of the two-phase refrigerant at the cold walls of the cooling circuit tubing which is further promoted by the high tubing lengths typical in many aircraft cooling systems.

The liquefied refrigerant may accumulate in the tubing of the cooling circuit and thus may no longer be available for circulation through the cooling circuit. This may cause failure of the cooling system. Nevertheless, a reliable operation of the cooling system at low ambient temperatures can be achieved by appropriately overdesigning the cooling circuit and in particular the amount of two-phase refrigerant circulating through the cooling circuit such that condensation of a part of the two-phase refrigerant at the cold walls of the cooling circuit tubing can be compensated for by excess gaseous refrigerant still present in the cooling circuit. To keep the system's structural and operational complexity as well as the system weight as low as possible and also for safety reasons it is, however, desirable, to employ as little refrigerant as possible.

SUMMARY

The invention is directed to the object to provide a lightweight and small-sized cooling system, in particular for use on board an aircraft, which is suitable for a reliable operation with a two-phase refrigerant under various environmental conditions and in particular at low ambient temperatures. The invention further is directed to the object to provide a method of operating a cooling system of this kind.

This object is achieved by a cooling system having features of attached claims and by a method of operating a cooling system having features of attached claims.

A cooling system, which is in particular suitable for use on board an aircraft for cooling heat generating components or food comprises a cooling circuit allowing circulation of a two-phase refrigerant therethrough. The two-phase refrigerant circulating in the cooling circuit is a refrigerant, which upon releasing cooling energy to a cooling energy consumer is converted from the liquid to the gaseous state of aggregation and is then converted back to the liquid state of aggregation. The two-phase refrigerant may for example be $CO_2$ or R134A ($CH_2F—CF_3$). Electric or electronic systems, such as avionic systems or fuel cell systems usually have to be cooled at a higher temperature level than food. For cooling these systems, for example Galden® can be used as a two-phase refrigerant. The evaporating temperature of Galden® at a pressure of 1 bar is approximately 60° C. A condenser of a cooling system employing Galden® as the two-phase refrigerant can be operated without a chiller and may, for example, be formed as a fin cooler or outer skin heat exchanger which is cooled by ambient air.

An evaporator of the cooling system, which forms an interface between the cooling circuit and a cooling energy consumer, is disposed in the cooling circuit and has a refrigerant inlet and a refrigerant outlet. The evaporator may, for example, be a heat exchanger which provides for a thermal coupling of the refrigerant flowing through the cooling circuit and a fluid to be cooled, such as for example air to be supplied to mobile transport containers for cooling food stored in the mobile transport containers or any heat generating component on board the aircraft. The two-phase refrigerant is supplied to the refrigerant inlet of the evaporator in its liquid state of aggregation. Upon releasing its cooling energy to the cooling energy consumer, the refrigerant is evaporated and thus exits the evaporator at the refrigerant outlet in its gaseous state of aggregation.

The cooling system further comprises a condenser, which is disposed in the cooling circuit and has a refrigerant inlet and a refrigerant outlet. The refrigerant which is evaporated in the evaporator, via a portion of the cooling circuit downstream of the evaporator and upstream of the condenser, is supplied to the refrigerant inlet of the condenser in its gaseous state of aggregation. In the condenser, the refrigerant is condensed and hence exits the condenser at the refrigerant outlet of the condenser in its liquid state of aggregation. The condenser can be a part of a chiller or can be supplied with cooling energy from a chiller. For example, the condenser may comprise a heat exchanger which provides for a thermal coupling of the refrigerant flowing through the cooling circuit and a cooling circuit of a chiller.

Refrigerant condensed in the condenser may be immediately directed back to the evaporator. It is, however, also conceivable to provide the cooling system with at least one accumulator which in the cooling circuit is disposed downstream of the condenser and thus can be supplied with liquid refrigerant from the condenser. Suitable valves can be provided for controlling the supply of refrigerant from the condenser to the accumulator(s) and/or from the accumulator(s) to the evaporator. Preferably, at least one accumulator of the cooling system comprises a subcooler which serves to subcool the refrigerant contained in the accumulator, as it is described in the non-published German patent application DE 10 2011 014 943.

In the cooling circuit, the condenser forms a "low-temperature location" where the refrigerant, after being converted into its gaseous state of aggregation in the evaporator, is converted back into its liquid state of aggregation. A particularly energy efficient operation of the cooling system is possible, if the condenser is installed at a location where heating of the condenser by ambient heat is avoided as far as possible. When the cooling system is employed on board an aircraft, the condenser preferably is installed outside of the heated aircraft cabin behind the secondary aircraft structure, for example in the wing fairing, the belly fairing or the tail cone. The same applies to the accumulator(s). Further, the condenser and/or the accumulator(s) may be insulated to maintain the heat input from the ambient as low as possible.

The cooling system further comprises a detection device which is configured to output a signal indicative of the state of aggregation of the refrigerant in a portion of the cooling circuit which connects the refrigerant outlet of the evaporator to the refrigerant inlet of the condenser. In other words, the detection device is configured to determine whether the refrigerant in a portion of the cooling circuit which connects the refrigerant outlet of the evaporator to the refrigerant inlet of the condenser, as desired, is in its gaseous state of aggregation or, for example due to condensation at cold walls of the cooling circuit tubing at low ambient temperatures, at least partially in its liquid state of aggregation.

The cooling system further comprises a control device which is configured to control the temperature and/or the pressure of the refrigerant in the portion of the cooling circuit which connects the refrigerant outlet of the evaporator to the refrigerant inlet of the condenser in dependence on the signal output by the detection device such that the refrigerant in said portion of the cooling circuit is maintained in its gaseous state of aggregation. The control device, by appropriately controlling the temperature and/or the pressure of the refrigerant thus ensures that an undesired condensation of the refrigerant in a portion of the cooling circuit where the refrigerant should prevail in its gaseous state of aggregation is prevented. Hence, the risk that the cooling circuit or a portion of the cooling circuit is flooded with the liquid refrigerant is eliminated.

By preventing an uncontrolled condensation of the refrigerant an even and controlled distribution of gaseous and liquid refrigerant within the cooling circuit of cooling system can be maintained. In particular, an undesired accumulation of liquefied refrigerant in the tubing of the cooling circuit which hinders the flow of gaseous refrigerant and reduces the amount of refrigerant available for circulation through the cooling circuit is avoided. As a result, reliable operation of the individual components of the cooling system can be ensured without it being necessary to overdesign the cooling circuit and the amount of refrigerant circulating through the cooling circuit. In particular, dry operation of a conveying device for conveying refrigerant through the cooling circuit and hence failure of the conveying device and thus the cooling system can be prevented. The cooling system thus can be small-sized and lightweight, but still is reliably operable also at low ambient temperatures.

In a preferred embodiment of the cooling system the control device is configured to increase the temperature of the refrigerant in the portion of the cooling circuit which connects the refrigerant outlet of the evaporator to the refrigerant inlet of the condenser, if the signal output by the detection device indicates an undesired condensation of the refrigerant in the portion of the cooling circuit which connects the refrigerant outlet of the evaporator to the refrigerant inlet of the condenser. Additionally or alternatively thereto, the control device may be configured to decrease the pressure of the refrigerant in the portion of the cooling circuit which connects the refrigerant outlet of the evaporator to the refrigerant inlet of the condenser, if the signal output by the detection device indicates an undesired condensation of the refrigerant inlet portion of the cooling circuit which connects the refrigerant outlet of the evaporator to the refrigerant inlet of the condenser. Both, a temperature increase and a pressure decrease of the refrigerant allows to maintain the refrigerant in its desired gaseous state of aggregation at low ambient temperatures resulting in temperatures of the tubing of the cooling system which are below the dew point of the refrigerant.

Control of the pressure of the refrigerant in the portion of the cooling circuit which connects the refrigerant outlet of the evaporator to the refrigerant inlet of the condenser may be achieved, for example, by appropriately controlling the operation of a conveying device for conveying refrigerant to the evaporator. Alternatively or additionally thereto, appropriate pressure control valves, which may for example be disposed in the cooling circuit, may be used to control the pressure of the refrigerant in the portion of the cooling circuit which connects the refrigerant outlet of the evaporator to the refrigerant inlet of the condenser such that an undesired condensation of the refrigerant is prevented. Further, a pressure decrease of the refrigerant in the cooling circuit may be accomplished by decreasing the operating temperature of the condenser and/or an optional subcooler. Operation of the evaporator may be interrupted until the desired pressure decrease is achieved.

An increase of the temperature of the refrigerant in the portion of the cooling circuit which connects the refrigerant outlet of the evaporator to the refrigerant inlet of the condenser may be achieved by heating a tubing of the portion of the cooling circuit. By heating the tubing the temperature of the tubing walls can be raised so as to exceed the dew point of the refrigerant. Further, heat input into the tubing of the cooling circuit portion connecting the refrigerant outlet of the evaporator to the refrigerant inlet of the condenser may be transferred to the refrigerant flowing through the cooling circuit portion. Hence, the refrigerant may be super-heated and thus is less susceptible to condensation at cold surfaces. Additionally or alternatively thereto, it is conceivable to directly heat the refrigerant. Preferably, the control device is configured to cease the heat input into the cooling circuit tubing and/or the refrigerant, as soon as the temperature of the tubing and or the refrigerant has reached a desired level. This reduces the amount of heat which has to be discharged from the cooling circuit in the condenser.

The control device of the cooling system thus may be configured to control the temperature of the refrigerant in the portion of the cooling circuit which connects the refrigerant outlet of the evaporator to the refrigerant inlet of the condenser by controlling the supply of heat energy to a tubing of the portion of the cooling circuit which connects the refrigerant outlet of the evaporator to the refrigerant inlet of the condenser. Alternatively or additionally thereto, the control device may be configured to control the supply of heat energy directly to the refrigerant in the portion of the cooling circuit which connects the refrigerant outlet of the evaporator to the refrigerant inlet of the condenser. Upon controlling the supply of heat energy to the tubing and/or directly to the refrigerant, the control device may take into account the pressure of the refrigerant in the portion of the cooling circuit which connects the refrigerant outlet of the evaporator to the refrigerant inlet of the condenser, since the temperature increase of the refrigerant necessary for maintaining the refrigerant in its desired gaseous state of aggregation, of course, depends on the pressure of the refrigerant and is lower at lower refrigerant pressures.

The tubing of the cooling circuit may be heated for example by heating an outer wall of the tubing. To increase the heat transfer to the tubing, the outer wall of the tubing may be provided with fins. The heat energy supplied to the tubing of the portion of the cooling circuit which connects the refrigerant outlet of the evaporator to the refrigerant inlet of the condenser may be provided by a heating device. The heating device may, for example, be an electric heating device comprising a heating wire, a heating mat, a heating cartridge or an electric air heater. The heating device may be disposed adjacent to the outer wall of the cooling circuit tubing or be integrated into an insulation of the tubing. It is, however, also possible to integrate the heating device, for example a heating device in the form of a heating cartridge, into the tubing. If the heating device is integrated into the tubing, an inner wall of the tubing may be provided with fins so as to increase the heat transfer from the heating device to the tubing. Additionally or alternatively to an electric heating device, a heating device may be employed which is operated with kerosene or hydrogen.

Further, the tubing and/or the refrigerant may be heated by a warm heating fluid, such as air, which, for example, by means of a fan is guided over an outer wall of the tubing. It is, however, also possible to integrate the tubing into one or more heat exchanger(s) installed along the length of the tubing between the refrigerant outlet of the evaporator and the refrigerant inlet of the condenser. The warm heating fluid for heating the tubing of the cooling circuit may be provided by an aircraft air conditioning system. Alternatively or additionally thereto, warm air discharged from an aircraft cabin (a passenger cabin or a cargo compartment) may be used to heat the cooling circuit tubing.

Moreover, exhaust heat generated by an aircraft component, such as for example an electric or electronic component, a fuel cell, an auxiliary power unit or an engine may be used to heat the cooling circuit tubing. A further source of exhaust heat for heating the tubing may be a chiller which is thermally coupled to the condenser of the cooling system and serves to supply cooling energy to the condenser during operation of the cooling system. The exhaust heat, for example in the form of warm air, may directly be used to heat the tubing. It is, however, also conceivable to use the exhaust to heat a heating fluid which is then conveyed to the cooling system for heating the tubing.

Finally, the tubing of the portion of the cooling circuit which connects the refrigerant outlet of the evaporator to the refrigerant inlet of the condenser may be heated by introducing heat energy which is provided by a heat source to be cooled by means of the evaporator. For example, heat which is generated by the heat source to be cooled by means of the evaporator first may be used to heat the cooling circuit tubing to the desired temperature before the residual heat is transferred to the refrigerant in the evaporator.

If desired, a plurality of heating devices may be provided along the length of the tubing to be heated. Preferably, these heating devices can be controlled independently from each other by the control device so as to allow a selective heating of individual portions of the tubing. This may be achieved, for example, by employing appropriate bypass lines and/or valves. A tubing provided with integrated heating devices, for example in the form of heating cartridges, may consist of multiple parts each incorporating an associated heating devices. In the event of failure of a single heating device, it is then possible to replace the tubing part together with the failed heating device.

A particularly energy efficient supply of heat to the tubing is possible, if the tubing is formed as a coaxial double tubing with a ring gap being provided between an inner tubing through which the refrigerant flows and an outer tubing. A gaseous or liquid heating fluid may then be directed through the ring gap ensuring evenly heating of the inner tubing. The outer wall of the inner tubing may be provided with fins so as to increase the heat transfer to the inner tubing. The insulation of the tubing may be applied to an outer wall of the outer tubing.

Direct heating of the refrigerant may, for example, be achieved by introducing heat energy into the evaporator, such that the refrigerant upon evaporation in the evaporator is super-heated. Further, it is conceivable to direct refrigerant flowing through the portion of the cooling circuit which connects the refrigerant outlet of the evaporator to the refrigerant inlet of the condenser, via a bypass line, to a heat source and to transfer heat from the heat source to the refrigerant so as to super-heat the refrigerant.

A super-heating of the refrigerant may be achieved by means of a suitable heating device. In particular, any one of the heating devices which are described above as being suitable for heating the cooling circuit tubing also may be employed for directly heating the refrigerant. Further, any one of the heat sources which are described above as being suitable for providing heat energy for heating the cooling circuit tubing also may be employed for providing heat energy for directly heating the refrigerant. A particularly energy efficient super-heating of the refrigerant may be achieved by employing a super-heater which is integrated into the evaporator. Further, it is conceivable to install the evaporator at a location that allows a portion of the evaporator to protrude into a warm environment, such as the aircraft cabin. During normal operation of the cooling system the portion of the evaporator protruding into the warm environment may be bypassed. If, however, super-heating of the refrigerant is desired, the refrigerant may be directed through the portion of the evaporator protruding into the warm environment and be heated by heat transfer from the warm environment.

Alternatively or additionally thereto, a super-heating of the refrigerant may be achieved by reducing the amount of refrigerant supplied to the evaporator while simultaneously keeping constant or increasing the introduction of heat into the evaporator. Hence, the control device of the cooling system preferably is configured to increase the temperature of the refrigerant in the portion of the cooling circuit which connects the refrigerant outlet to the evaporator to the refrigerant inlet of the condenser by reducing the supply of refrigerant from the condenser to the evaporator. This may for example be achieved by an appropriate control of the operation of the condenser, of the operation of a conveying device for conveying the refrigerant from the condenser to the evaporator and/or of the operation of appropriate valves disposed in the cooling circuit.

In the cooling system according to the invention the control device may further be configured to prevent start-up of the cooling system and/or to shut down the cooling system, if the signal output by the detection device indicates an undesired condensation of the refrigerant in the portion of the cooling circuit which connects the refrigerant outlet of the evaporator to the refrigerant inlet of the condenser. In other words, the control device is configured to disable the cooling system, if undesired liquid refrigerant is present in the cooling circuit. Further, the control device may be configured to allow start-up of the cooling system and/or to restart the cooling system when the temperature and/or the pressure of the refrigerant in the portion of the cooling circuit which connects the refrigerant outlet of the evaporator to the refrigerant inlet of the condenser, under the control of the control device, is adjusted such that the refrigerant in said portion of the cooling circuit is maintained in its gaseous state of aggregation. By preventing operation of the cooling system under unfavorable operating conditions failure of the cooling system can be avoided.

The control device further may be configured to prevent the supply of refrigerant from the condenser to the evaporator, if the signal output by the detection device indicates an undesired condensation of the refrigerant in the portion of the cooling circuit which connects the refrigerant outlet of the evaporator the refrigerant inlet of the condenser, and to allow the supply of refrigerant from the condenser to the evaporator when the temperature of the refrigerant in the portion of the cooling circuit which connects the refrigerant outlet of the evaporator to the refrigerant inlet of the condenser, by introducing heat energy provided by a heat source to be cooled by means of the evaporator, is adjusted such that the refrigerant in said portion of the cooling circuit is maintained in its gaseous state of aggregation. In other words, if the signal output by the detection device indicates an undesired condensation of the refrigerant in the portion of the cooling circuit which connects the refrigerant outlet of the evaporator the refrigerant inlet of the condenser, the control device allows start-up of the cooling system insofar that heat is supplied to the evaporator by the heat source to be cooled. The supply of liquid refrigerant provided by the condenser to the evaporator, however is ceased until the evaporator and the tubing of the cooling circuit downstream of the evaporator is heated to a temperature which ensures that the refrigerant in the portion of the cooling circuit which connects the refrigerant outlet of the evaporator to the refrigerant inlet of the condenser is maintained in its gaseous state of aggregation. If desired, the condenser, under the control of the control device, may be operated so as to produce liquid refrigerant which may for example be discharged to an accumulator until the supply of the refrigerant to the evaporator is enabled.

A tubing of the portion of the cooling circuit which connects the refrigerant outlet of the evaporator to the refrigerant inlet of the condenser preferably is inclined from the refrigerant outlet of the evaporator to the refrigerant inlet of the condenser. Refrigerant in its liquid state of aggregation then gravity driven is supplied to the condenser and thus no longer is accumulated in cooling circuit tubing where it might hinder the flow of gaseous refrigerant through the tubing. Alternatively or additionally thereto, the tubing of the portion of the cooling circuit which connects the refrigerant outlet of the evaporator to the refrigerant inlet of the condenser may be provided with at least one lowering wherein refrigerant in its liquid state of aggregation is accumulated. By accumulating the liquid refrigerant in lowering(s) of the cooling circuit tubing the liquid refrigerant is removed from the main flow path of the tubing such that the flow gaseous refrigerant through the tubing is not impeded. A heating device for heating the tubing and/or the refrigerant may be adapted to introduce heat into the tubing and/or the refrigerant in a region of the lowering(s) such that the liquid refrigerant collected in the lowering is converted back into its desired gaseous state of aggregation.

The detection device of the cooling system preferably comprises at least one temperature sensor which is adapted to measure a temperature of a tubing of the portion of the cooling circuit which connects the refrigerant outlet of the evaporator to the refrigerant inlet of the condenser and/or a temperature of the refrigerant in the portion on the cooling circuit which connects the refrigerant outlet of the evaporator to the refrigerant inlet of the condenser. Using the temperature of the cooling circuit tubing and/or the refrigerant as an indicator of the state of aggregation of the refrigerant allows the control device to control the operation of the cooling system in a particularly simple manner, since only one parameter, namely the temperature, has to be processed by the control device. It is, however, also conceivable to employ a detection device comprising at least one pressure sensor which is adapted to measure a pressure of the refrigerant in the portion of the cooling circuit which connects the refrigerant outlet of the evaporator to the refrigerant inlet of the condenser. If the control device is provided with signals indicative of the temperature and the pressure of the refrigerant, the state of aggregation of the refrigerant can be determined in a particularly reliable manner. If desired, a plurality of temperature and/or pressure sensors may be provided along the length of the portion of the cooling circuit which connects the refrigerant outlet of the evaporator to the refrigerant inlet of the condenser. Such a configuration allows to determine unsteady operating conditions in different portions of the cooling circuit.

A method of operating a cooling system which is in particular suitable for use on board an aircraft comprises the steps of circulating a two-phase refrigerant through a cooling circuit, evaporating the refrigerant in an evaporator disposed in the cooling circuit and having a refrigerant inlet and a refrigerant outlet, and condensing the refrigerant in a condenser disposed in the cooling circuit and having a refrigerant inlet and a refrigerant outlet. A signal indicative of the state of aggregation of the refrigerant in a portion of the cooling circuit which connects the refrigerant outlet of the evaporator to the refrigerant inlet of the condenser is detected and output. Finally, the temperature and/or the pressure of the refrigerant in the portion of the cooling circuit which connects the refrigerant outlet of the evaporator to the refrigerant inlet of the condenser is controlled in dependence on the signal indicative of the state of aggregation of the refrigerant in a portion of the cooling circuit which connects the refrigerant outlet of the evaporator to the refrigerant inlet of the condenser such that the refrigerant in said portion of the cooling circuit is maintained in its gaseous state of aggregation.

Preferably, the temperature of the refrigerant in the portion of the cooling circuit which connects the refrigerant outlet of the evaporator to the refrigerant inlet of the condenser is increased and/or the pressure of the refrigerant in the portion of the cooling circuit which connects the refrigerant outlet of the evaporator to the refrigerant inlet of the condenser is decreased, if the signal indicative of the state of aggregation of the refrigerant in the portion of the cooling circuit which connects the refrigerant outlet of the evaporator to the refrigerant inlet of the condenser indicates an undesired condensation of the refrigerant in the portion of the cooling circuit which connects the refrigerant outlet of the evaporator to the refrigerant inlet of the condenser.

Preferably, the temperature of the refrigerant in the portion of the cooling circuit which connects the refrigerant outlet of the evaporator to the refrigerant inlet of the condenser is controlled by controlling the supply of heat energy to a tubing of the portion of the cooling circuit which connects the refrigerant outlet of the evaporator to the refrigerant inlet of the condenser and/or directly to the refrigerant in the portion of the cooling circuit which connects the refrigerant outlet of the evaporator to the refrigerant inlet of the condenser.

The heat energy supplied to the tubing of the portion of the cooling circuit which connects the refrigerant outlet of the evaporator to the refrigerant inlet of the condenser and/or directly to the refrigerant in the portion of the cooling circuit which connects the refrigerant outlet of the evaporator to the refrigerant inlet of the condenser may be provided by a heating device and/or an aircraft air conditioning system, may be provided by a heat source to be cooled by means of the evaporator, may be exhaust heat generated by an aircraft component during operation, and/or may be provided by warm air discharged from an aircraft cabin.

Preferably, the temperature of the refrigerant in the portion of the cooling circuit which connects the refrigerant outlet of the evaporator to the refrigerant inlet of the condenser is increased by reducing the supply of refrigerant from the condenser to the evaporator.

Start-up of the cooling system may be prevented and/or shut-down of the cooling system may be initiated, if the signal indicative of the state of aggregation of the refrigerant in the portion of the cooling circuit which connects the refrigerant outlet of the evaporator to the refrigerant inlet of the condenser indicates an undesired condensation of the refrigerant in the portion of the cooling circuit which connects the refrigerant outlet of the evaporator to the refrigerant inlet of the condenser. Further, start-up of the cooling system and/or restart the cooling system may be allowed when the temperature and/or the pressure of the refrigerant in the portion of the cooling circuit which connects the refrigerant outlet of the evaporator to the refrigerant inlet of the condenser is adjusted such that the refrigerant is maintained in its gaseous state of aggregation.

The supply of refrigerant from the condenser to the evaporator may be prevented, if the signal indicative of the state of aggregation of the refrigerant in the portion of the cooling circuit which connects the refrigerant outlet of the evaporator to the refrigerant inlet of the condenser indicates an undesired condensation of the refrigerant in the portion of the cooling circuit which connects the refrigerant outlet of the evaporator to the refrigerant inlet of the condenser. Further, the supply of refrigerant from the condenser to the evaporator may be allowed when the temperature of the refrigerant in the portion of the cooling circuit which connects the refrigerant outlet of the evaporator to the refrigerant inlet of the condense, by introducing heat energy provided by a heat source to be cooled by means of the evaporator, is increased such that the refrigerant in said portion of the cooling circuit is maintained in its gaseous state of aggregation.

BRIEF DESCRIPTION OF DRAWINGS

A preferred embodiment of the invention now is described in more detail with reference to the enclosed schematic drawings, wherein.

DETAILED DESCRIPTION OF EMBODIMENTS

Figure 1:
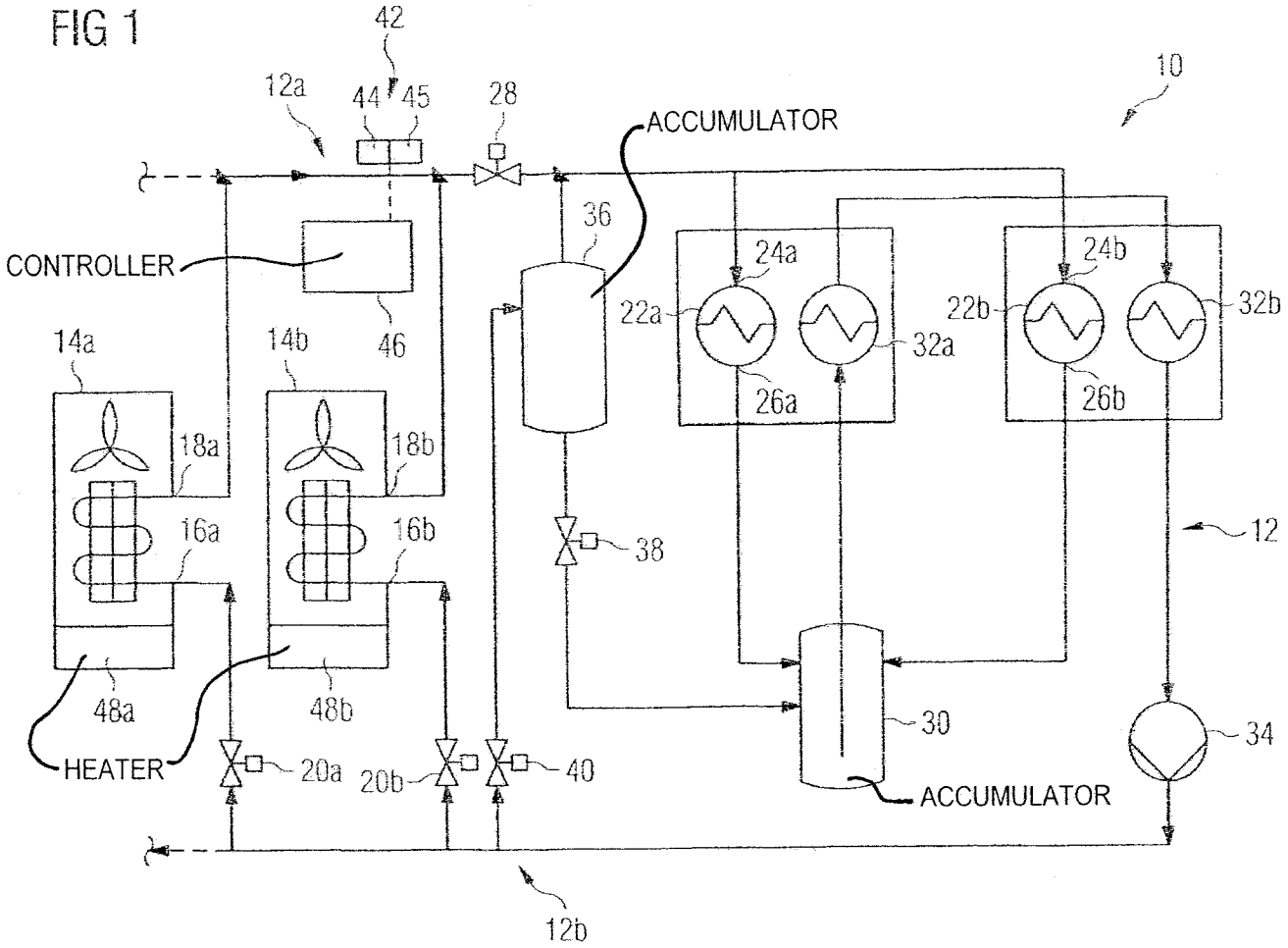
FIG. 1 depicts an overview over an aircraft cooling system suitable for operation with a two-phase refrigerant.

FIG. 1 depicts a cooling system 10 which on board an aircraft, for example, may be employed to cool food provided for supplying to the passengers. The cooling system 10 comprises a cooling circuit 12 allowing circulation of a two-phase refrigerant therethrough. The two-phase refrigerant may for example be $CO_2$ or R134A. A first and a second evaporator 14*a*, 14*b* are disposed in the cooling circuit 12. Each evaporator 14*a*, 14*b* comprises a refrigerant inlet 16*a*, 16*b* and a refrigerant outlet 18*a*, 18*b*. The refrigerant flowing through the cooling circuit 12 is supplied to the refrigerant inlets 16*a*, 16*b* of the evaporators 14*a*, 14*b* in its liquid state of aggregation. Upon flowing through the evaporators 14*a*, 14*b*, the refrigerant releases its cooling energy to a cooling energy consumer which in the embodiment of a cooling system 10 depicted in FIG. 1 is formed by the food to be cooled. Upon releasing its cooling energy, the refrigerant is evaporated and hence exits the evaporators 14*a*, 14*b* at the refrigerant outlets 18*a*, 18*b* of the evaporators 14*a*, 14*b* in its gaseous state of aggregation. The supply of refrigerant to the evaporators 14*a*, 14*b* is controlled by respective valves 20*a*, 20*b* which are disposed in the cooling circuit 12 upstream of the first and the second evaporator 14*a*, 14*b*, respectively.

Further, the cooling system 10 comprises a first and a second condenser 22*a*, 22*b*. Each condenser 22*a*, 22*b* has a refrigerant inlet 24*a*, 24*b* and a refrigerant outlet 26*a*, 26*b*. The refrigerant which is evaporated in the evaporators 14*a*, 14*b*, via a portion 12*a* of the cooling circuit 12 downstream of the evaporators 14*a*, 14*b* and upstream of the condensers 22*a*, 22*b*, is supplied to the refrigerant inlets 24*a*, 24*b* of the condensers 22*a*, 22*b* in its gaseous state of aggregation. The supply of refrigerant from the evaporators 14*a*, 14*b* to the condensers 22*a*, 22*b* is controlled by means of a valve 28. The condensers 22*a*, 22*b* are thermally coupled to a chiller (not shown in FIG. 1). The cooling energy provided by the chiller in the condensers 22*a*, 22*b* is used to condense the refrigerant. Thus, the refrigerant exits the condensers 22*a*, 22*b* at the refrigerant outlets 26*a*, 26*b* of the condensers 22*a*, 22*b* in its liquid state of aggregation.

Liquid refrigerant from the condensers 22*a*, 22*b* is supplied to a first accumulator 30. The first accumulator 30 may, for example, be an accumulator as it is described in the non-published German patent application DE 10 2011 014 943. Liquid refrigerant from a sump of the first accumulator 30 is directed to a first and second subcooler 32*a*, 32. The first subcooler 32*a* is associated with the first condenser 22*a* and the second subcooler 32*b* is associated with the second condenser 22*b*. The subcoolers 32*a*, 32*b* serve to subcool the liquid refrigerant and to thus prevent an undesired evaporation of the refrigerant. This ensures that the refrigerant is supplied to a conveying device 34, which in the embodiment of a cooling system 10 depicted in FIG. 1 is embodied in the form of a pump, in its liquid state of aggregation. Thus, dry operation of the pump and failure of the pump can be prevented.

Finally, the cooling system 10 comprises a second accumulator 36. The second accumulator 36 is disposed in the cooling circuit 12 downstream of the conveying device 34, wherein the supply of refrigerant to the second accumulator 36 is controlled by means of a valve 40. The second accumulator 36 serves as backup reservoir for operational situations of the cooling system 10, wherein the volume of the first accumulator 30 is not sufficient so as to receive the entire amount of liquid refrigerant provided by the condensers 22*a*, 22*b*. A valve 38 serves to control the supply of refrigerant from the second accumulator 36 to the first accumulator 30.

During normal operation of the cooling system 10, the refrigerant flowing through the cooling circuit 12 in the portion 12*a* of the cooling circuit 12 which connects the refrigerant outlets 18*a*, 18*b* of the evaporators 14*a*, 14*b* to the refrigerant inlets 24*a*, 24*b* of the condensers 22*a*, 22*b* is in its gaseous state of aggregation. Contrary thereto, in a portion 12*b* of the cooling circuit 12 which connects the refrigerant outlet 26*a*, 26*b* of the condensers 22*a*, 22*b* to the refrigerant inlets 16*a*, 16*b* of the evaporators 14*a*, 14*b*, the refrigerant is in its liquid state of aggregation. In particular at low ambient temperatures, the temperature of a tubing of the cooling circuit 12, although being provided with an insulation, falls below a dew point of the two-phase refrigerant. In the portion 12*a* of the cooling circuit 12 which connects the refrigerant outlets 16*a*, 16*b* of the evaporators 14*a*, 14*b* to the refrigerant inlets 24*a*, 24*b* of the condensers 22*a*, 22*b* this may result in an undesired condensation of the two-phase refrigerant.

The cooling system 10 therefore further comprises a detection device 42 including a temperature sensor 44 and a pressure sensor 45. The temperature sensor 44 measures the temperature of the refrigerant flowing through the cooling circuit portion 12*a*, while the pressure sensor 45 measures the pressure of the refrigerant flowing through the cooling circuit portion 12*a*. Both, the temperature and the pressure of the refrigerant in the cooling circuit portion 12*a* are indicative of the state of aggregation of the refrigerant flowing through the cooling circuit portion 12*a*. The detection device 42 thus is configured to output a signal indicative of the state of aggregation of the refrigerant.

The signal output by the detection device 42 is supplied to a control device 46. The control device 46 is configured to control the temperature and the pressure of the refrigerant in the cooling circuit portion 12*a* in dependence on the signal provided to the control device 46 by the detection device 42 such that the refrigerant in the cooling circuit portion 12*a* is maintained in its gaseous state of aggregation. For maintaining the refrigerant flowing through the cooling circuit portion 12*a* in its gaseous state of aggregation the control device 46 controls the operation of the components of the cooling system 10 such that the pressure of the refrigerant in the cooling circuit portion 12*a* is decreased and/or such that the temperature of the refrigerant in the cooling circuit portion 12*a* is increased. In particular, to increase the temperature of the refrigerant in the cooling circuit portion 12*a*, the control device 46 controls the operation of heating devices 48*a*, 48*b*.

Figure 2:
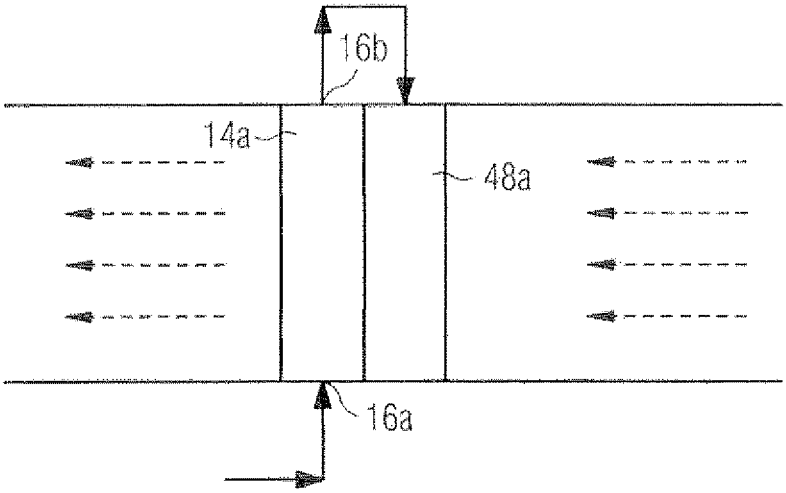
FIG. 2 shows a detailed view of an evaporator employed in the cooling system of FIG. 1.

As depicted in FIG. 2, in the embodiment of a cooling system 10 according to FIG. 1, the heating devices 48*a*, 48*b* are embodied in the form of super-heaters integrated into each of the evaporators 14*a*, 14*b*. To avoid an unnecessary input of heat into the refrigerant which during operation of the cooling system 10 has to be removed by the condensers 22*a*, 22*b*, the heating devices 48*a*, 48*b*, under the control of the control device 46, are operated only as long as the signal output by the detection device 42 indicates an undesired condensation of the refrigerant in the cooling circuit portion 12*a*. That is, operation of the heating devices 48*a*, 48*b* is ceased as soon as the refrigerant in the cooling circuit portion 12*a* can be maintained in its gaseous state of aggregation also without additional heating. Although the cooling system 10 of FIG. 1 comprises heating devices 48*a*, 48*b* in the form of superheaters integrated into the evaporators 14*a*, 14*b*, the cooling system 10 may also be provided with a different kind of heating device which may be suitable to either directly heat the refrigerant in the cooling circuit portion 12*a* or to heat a tubing of the cooling circuit portion 12*a*.

To increase the temperature of the refrigerant in the cooling circuit portion 12*a*, the control device 46 may also control the operation of the condenser 22*a*, 22*b*, the operation of the conveying device 34 and/or the operation of the valves 20*a*, 20*b* and/or 40, such that the amount of refrigerant supplied to the evaporators 14*a*, 14*b* is reduced while the introduction of heat into the evaporators 12*a*, 12*b* by the cooling energy consumers is kept constant or increased.

To control the pressure of the refrigerant in the cooling circuit portion 12*a*, the control device 46 may appropriately control the operation of the conveying device 34 and/or the operation of the valves 20*a*, 20*b*. Further, a pressure decrease of the refrigerant in the cooling circuit portion 12*a* may be accomplished by decreasing the operating temperature of the condensers 22*a*, 22*b* and/or the subcoolers 32*a*, 32*b* under the control of the control device 46.

By preventing an uncontrolled condensation of the refrigerant an even and controlled distribution of gaseous and liquid refrigerant within the cooling circuit 12 of cooling system 10 can be maintained. In particular, an undesired accumulation of liquefied refrigerant in the tubing of the cooling circuit 12 which hinders the flow of gaseous refrigerant reduces the amount of refrigerant available for circulation through the cooling circuit is avoided. As a result, reliable operation of the individual components of the cooling system 10 can be ensured also at low ambient temperatures. The tubing of the cooling circuit portion 12*a* is inclined from the refrigerant outlets 18*a*, 18*b* of the evaporators 14*a*, 14*b* to the refrigerant inlets 24*a*, 24*b* of the condensers 22*a*, 22*b*. Any liquid refrigerant then gravity driven is supplied to the condensers 22*a*, 22*b* and thus does not hinder the flow of gaseous refrigerant through the cooling circuit portion 12*a*.

Upon start-up of the cooling system 10 the control device 46 prevents start-up of the cooling system 10, if the signal output by the detection device 42 indicates an undesired condensation of the refrigerant in the cooling circuit portion 12*a*. Further, during operation of cooling system 10, the control device initiates shut down of the cooling system 10, if the signal output by the detection device 42 indicates an undesired condensation of the refrigerant in the cooling circuit portion 12*a*. Thus, operation of the cooling system 10 under unfavourable conditions is avoided. The control device 46, however, allows start-up of the cooling system 10 and/or restarts the cooling system 10 as soon as the temperature and/or the pressure of the refrigerant in the cooling circuit portion 12*a*, under the control of the control device 46, is adjusted such that the refrigerant is maintained in its gaseous state of aggregation.

Moreover, upon start-up of the cooling system 10 the control device 46 may prevent the supply of the refrigerant from the condensers 22*a*, 22*b* to the evaporators 14*a*, 14*b*, if the signal output by the detection device 42 indicates an undesired condensation of the refrigerant in the cooling circuit portion 12*a*. The control device 46, however, may allow the supply of refrigerant from the condenser 22*a*, 22*b* to the evaporators 14*a*, 14*b* as soon as the temperature of the refrigerant in the cooling circuit portion 12*a*, by introducing heat energy provided by the cooling energy consumer to be cooled by means of the evaporators 14*a*, 14*b* is adjusted such that the refrigerant is maintained in its gaseous state of aggregation.

In other words, if the signal output by the detection device 42 indicates an undesired condensation of the refrigerant in the cooling circuit portion 12*a*, the control device 46 allows start-up of the cooling system 10 insofar that heat is supplied to the evaporators 14*a*, 14*b* by the cooling energy consumers. The supply of liquid refrigerant provided by the condensers 22*a*, 22*b* to the evaporators 14*a*, 14*b*, however, is ceased until the evaporators 14*a*, 14*b* and the tubing of the cooling circuit portion 12*a* is heated to a temperature which ensures that the refrigerant in the cooling circuit portion 12*a* is maintained in its gaseous state of aggregation. The condensers 22*a*, 22*b*, under the control of the control device 36, may be operated so as to produce liquid refrigerant which is discharged to the accumulators 30, 36 until the supply of refrigerant to the evaporators 14*a*, 14*b* is enabled.

The invention claimed is:

1. A cooling system, in particular for use on board an aircraft, the cooling system comprising:

a cooling circuit allowing circulation of a two-phase refrigerant therethrough, an evaporator disposed in the cooling circuit and having a refrigerant inlet and a refrigerant outlet, a condenser disposed in the cooling circuit and having a refrigerant inlet and a refrigerant outlet, a state detector configured to output a signal indicative of the state of aggregation of the refrigerant in a portion of the cooling circuit which connects the refrigerant outlet of the evaporator to the refrigerant inlet of the condenser, and a controller structured to maintain the refrigerant in said portion of the cooling circuit in its gaseous state of aggregation by controlling at least one of increasing the temperature of the refrigerant in said portion of the cooling circuit and decreasing the pressure of the refrigerant in said portion of the cooling circuit, in an event that the signal output by the state detector indicates an undesired condensation of the refrigerant in said portion of the cooling circuit.

2. The cooling system according to claim 1, wherein the controller is configured to control the temperature of the refrigerant in said portion of the cooling circuit by controlling the supply of heat energy to a tubing of said portion of the cooling circuit and/or directly to the refrigerant in said portion of the cooling circuit.

3. The cooling system according to claim 2, wherein the heat energy supplied to the tubing of said portion of the cooling circuit and/or directly to the refrigerant in said portion of the cooling circuit is provided by at least one of a heating device, an aircraft air conditioning system, a heat source to be cooled by the evaporator, warm air discharged from an aircraft cabin, and exhaust heat generated by an aircraft component during operation.

4. The cooling system according to claim 1, wherein the controller is configured to increase the temperature of the refrigerant in said portion of the cooling circuit by reducing the supply of refrigerant from the condenser to the evaporator.

5. The cooling system according to claim 1, wherein the controller is configured prevent start-up of the cooling system and/or to shut-down the cooling system, in an event that the signal output by the detection device indicates an undesired condensation of the refrigerant in said portion of the cooling circuit, and to allow start-up of the cooling system and/or to re-start the cooling system when at least one of the temperature and the pressure of the refrigerant in said portion of the cooling circuit, under the control of the controller, is adjusted such that the refrigerant in said portion of the cooling circuit is maintained in its gaseous state of aggregation.

6. The cooling system according to claim 1, wherein the controller is configured prevent the supply of refrigerant from the condenser to the evaporator, in an event that the signal output by the detection device indicates an undesired condensation of the refrigerant in said portion of the cooling circuit, and to allow the supply of refrigerant from the condenser to the evaporator when the temperature of the refrigerant in said portion of the cooling circuit, by introducing heat energy provided by a heat source to be cooled by the evaporator, is adjusted such that the refrigerant in said portion of the cooling circuit is maintained in its gaseous state of aggregation.

7. The cooling system according to claim 1, wherein a tubing of said portion of the cooling circuit has a downward slope from the refrigerant outlet of the evaporator to the refrigerant inlet of the condenser and/or is provided with at least one lowering, wherein refrigerant in its liquid state of aggregation is collected.

8. The cooling system according to claim 1, wherein the state detector comprises at least one of at least one temperature sensor which is configured to measure at least one of a temperature of a tubing of said portion of the cooling circuit and a temperature of the refrigerant in said portion of the cooling circuit, and at least one pressure sensor which is configured to measure a pressure of the refrigerant in said portion of the cooling circuit.

9. A method of operating a cooling system, in particular for use on board an aircraft, the method comprising the steps of:

circulating a two-phase refrigerant through a cooling circuit, evaporating the refrigerant in an evaporator disposed in the cooling circuit and having a refrigerant inlet and a refrigerant outlet, condensing the refrigerant in a condenser disposed in the cooling circuit and having a refrigerant inlet and a refrigerant outlet, detecting outputting of a signal indicative of the state of aggregation of the refrigerant in a portion of the cooling circuit which connects the refrigerant outlet of the evaporator to the refrigerant inlet of the condenser, outputting said signal indicative of the state of aggregation of the refrigerant in said portion of the cooling circuit, and controlling, by a controller, at least one of the temperature and the pressure of the refrigerant in said portion of the cooling circuit in dependence on the signal indicative of the state of aggregation of the refrigerant in said portion of the cooling circuit such that the refrigerant in said portion of the cooling circuit is maintained in its gaseous state of aggregation, wherein the temperature of the refrigerant in said portion of the cooling circuit is increased, in an event that the signal indicating the state of aggregation of the refrigerant in said portion of the cooling circuit indicates an undesired condensation of the refrigerant in said portion of the cooling circuit, and wherein the pressure of the refrigerant in said portion of the cooling circuit is decreased, in an event that the signal indicating the state of aggregation of the refrigerant in said portion of the cooling circuit indicates an undesired condensation of the refrigerant in said portion of the cooling circuit.

10. The method according to claim 9, further comprising controlling the temperature of the refrigerant in said portion of the cooling circuit by controlling the supply of heat energy to a tubing of said portion of the cooling circuit and/or directly to the refrigerant in said portion of the cooling circuit.

11. The method according to claim 10, further comprising providing the heat energy supplied to the tubing of said portion of the cooling circuit and/or directly to the refrigerant in said portion of the cooling circuit by at least one of a heating device, an aircraft air conditioning system, a heat source to be cooled by the evaporator, warm air discharged from an aircraft cabin, and exhaust heat generated by an aircraft component during operation.

12. The method according to claim 9, further comprising increasing the temperature of the refrigerant in said portion of the cooling circuit by reducing the supply of refrigerant from the condenser to the evaporator.

13. The method according to claim 9, further comprising preventing start-up of the cooling system and/or initiating shut-down of the cooling system, in an event that the signal indicative of the state of aggregation of the refrigerant in said portion of the cooling circuit indicates an undesired condensation of the refrigerant in said portion of the cooling circuit, and allowing start-up of the cooling system and/or re-start the cooling system when at least one of the temperature and the pressure of the refrigerant in said portion of the cooling circuit is adjusted such that the refrigerant in said portion of the cooling circuit is maintained in its gaseous state of aggregation.

14. The method according to claim 9, further comprising preventing the supply of refrigerant from the condenser to the evaporator, in an event that the signal indicative of the state of aggregation of the refrigerant in said portion of the cooling circuit indicates an undesired condensation of the refrigerant in said portion of the cooling circuit, and allowing the supply of refrigerant from the condenser to the evaporator when the temperature of the refrigerant in said portion of the cooling circuit, by introducing heat energy provided by a heat source to be cooled by the evaporator, is increased such that the refrigerant in said portion of the cooling circuit is maintained in its gaseous state of aggregation.

* * * * *